US005286563A

United States Patent [19]

Takahashi et al.

[11] Patent Number: 5,286,563

[45] Date of Patent: Feb. 15, 1994

[54] ACRYLIC FIBER STRAND SUITABLE FOR USE IN CARBON FIBER PRODUCTION AND PROCESS FOR PRODUCING THE SAME

[75] Inventors: Hayashi Takahashi; Kazuhiro Yamamoto, both of Shizuoka, Japan

[73] Assignee: Toho Rayon Co., Ltd., Tokyo, Japan

[21] Appl. No.: 811,529

[22] Filed: Dec. 20, 1991

[30] Foreign Application Priority Data

Dec. 22, 1990 [JP] Japan ..... 2-418285

[51] Int. Cl.[5] ..... B05D 3/02

[52] U.S. Cl. ..... 428/394; 428/375; 428/378; 428/391; 8/115.6; 252/8.7; 264/29.2

[58] Field of Search ..... 428/362, 375, 391, 394, 428/378, 370; 264/291.22; 423/447.4; 252/8.7; 8/115.6

[56] References Cited

U.S. PATENT DOCUMENTS

| | | | |
|---|---|---|---|
| 3,306,850 | 2/1967 | Olsen | 252/8.7 |
| 3,428,560 | 2/1969 | Olsen | 252/8.7 |
| 3,655,420 | 4/1972 | Tichenor | 8/115.6 |
| 3,708,326 | 1/1973 | Chenevey et al. . | |
| 3,950,473 | 4/1976 | Iwahori et al. | 264/141 |
| 4,009,248 | 2/1977 | Kishimoto et al. | 423/447.6 |
| 4,020,199 | 4/1977 | Nomura et al. | 428/391 |
| 4,259,307 | 3/1981 | Maruyama | 423/447.4 |
| 4,292,182 | 9/1981 | Jahn | 8/115.6 |
| 4,378,343 | 3/1983 | Sugiura et al. | 423/447.4 |
| 4,389,456 | 6/1983 | Marshall | 8/115.6 |
| 4,496,631 | 1/1983 | Adachi et al. | 428/394 |
| 4,551,382 | 11/1985 | Gagne et al. | 428/394 |
| 4,830,845 | 5/1989 | Ogawa et al. | 423/447.4 |
| 4,869,856 | 9/1989 | Takahashi et al. | 264/29.2 |
| 5,102,724 | 4/1992 | Okawahara et al. | 428/370 |

FOREIGN PATENT DOCUMENTS

| | | |
|---|---|---|
| 0159120 | 10/1984 | European Pat. Off. . |
| 0157499 | 10/1985 | European Pat. Off. . |

*Primary Examiner*—Patrick J. Ryan
*Assistant Examiner*—N. Edwards
*Attorney, Agent, or Firm*—Sughrue, Mion, Zinn Macpeak & Seas

[57] ABSTRACT

This invention relates to acrylic fiber strands suitable for use in production of carbon fibers and to a process for the production of the acrylic fiber used, in which an aminopolysiloxane and a dialkyl sulfosuccinate are coated on acrylic polymer filaments which permits the avoidance of problems such as the generation of static electricity and the deposition of an oil scum on rollers and guides. Because of such effects, excellent bundlability of fiber strands and stable operation of the carbonization process can be attained. The acrylic fiber strands thus obtained can be used for the production of high quality carbon fiber strands.

8 Claims, No Drawings

ACRYLIC FIBER STRAND SUITABLE FOR USE IN CARBON FIBER PRODUCTION AND PROCESS FOR PRODUCING THE SAME

FIELD OF THE INVENTION

This invention relates to an acrylic fiber strand suitable for use in the production of carbon fiber, which contains specified components, and to a process for the production of the acrylic fiber strand. By the use of the acrylic fiber strand, operation stability during carbonization processing can be improved and high quality carbon fibers can be produced.

BACKGROUND OF THE INVENTION

When a carbon fiber strand is produced from an acrylic fiber strand, it is necessary to carry out a preoxidizing treatment (flame resistance providing treatment) in an atmosphere of an oxidizing gas at a temperature generally of from 200° to 300° C. and then a carbonization treatment or graphitization treatment in an inert gas atmosphere at a temperature of 350° C. or higher. Methods for production of carbon fibers are given in detail in, for example, U.S. Pat. Nos. 4,069,297, 4,073,870 and 4,321,446. Especially, during the pre-oxidizing treatment at 200° to 300° C., it is important to prevent the mutual coalescence of filaments which constitute the fiber strand. For this purpose, methods which involve applying various silicone oils to the acrylic fiber strand have been proposed, such as the use of aminopolysiloxane oils as disclosed in JP-A-52-24136 and JP-A-61-167024. (The term "JP-A" as used herein means an "unexamined published Japanese patent application".)

Although the aminopolysiloxane oils applied to water-swollen filaments after spinning in the production of acrylic fiber strands are effective for the purpose of preventing coalescence during a preoxidation treatment, the surface of the fibers becomes water repellent which subsequently causes the generation of static electricity in dried fibers and the deposition of viscous scum on rollers and guides. Because of this, bundlability of the filaments in a strand is disturbed which results in problems such as fluffing, winding of filaments and the like.

In order to overcome these problems, various methods have been proposed, such as a method in which a copolymer containing both amino and polyoxyalkylene groups in one molecule is applied to the fiber strand (JP-A-61-97477 (corresponding to U.S. Pat. No. 4,830,845)), and a method in which a mixture of an aminopolysiloxane and various additives is applied to the fiber strand (JP-A-56-49022 (corresponding to U.S. Pat. No. 4,378,343), JP-A-55-103313 (corresponding to U.S. Pat. No. 4,259,307), JP-A-2-91224, JP-A-2-91225 and JP-A-2-91226).

Since in such methods some antioxidizing agents are used, film formation of the aminopolysiloxane is delayed or inhibited. Therefore, spreading of fiber strands which is caused by the wind pressure of a circulating oxidizing gas in a normal preoxidizing step cannot be prevented. In addition, because of the addition of antioxidizing agents, thermal decomposition of the aminopolysiloxane shifts from the preoxidizing step to the subsequent carbonization step which is operated at a higher temperature. The gas generated during the carbonization step not only causes corrosion of the surface of carbon fibers but also causes difficulty in achieving long term continuous operation due to deposition of the gas on the furnace wall.

SUMMARY OF THE INVENTION

The first object of the present invention is to provide an acrylic fiber strand with reduced generation of static electricity and reduced formation of oil scum.

The second object of the present invention is to provide an acrylic fiber strand which has improved filaments bundlability in the strand, reduced fluffing and winding of filaments on rollers or other portions of treating equipment.

The third object of the present invention is to provide an acrylic fiber strand which has excellent operational stability.

The fourth object of the present invention is to provide an acrylic fiber strand for use in the production of carbon fibers having excellent qualities such as high mechanical strength, no mutual coalescence of filaments, and no breakage of filaments.

The fifth object of the present invention is to provide a method for the production of an acrylic fiber strand having the above-described characteristics.

Other objects and advantages will be made apparent from the following disclosure.

According to the present invention, there is provided an acrylic fiber strand suitable for use in the production of carbon fiber, which comprises acrylic polymer filaments coated with (A) an aminopolysiloxane and (B) a dialkyl sulfosuccinate.

The present invention also provides a process for producing the acrylic fiber strand, which comprises applying components (A) and (B) to fibers.

DETAILED DESCRIPTION OF THE INVENTION

According to the present invention, any aminopolysiloxane may be used provided that it forms a film when heated at a preoxidizing temperature preferably of from 200° to 300° C.

Preferred component (A) is an aminopolysiloxane represented by formula (1):

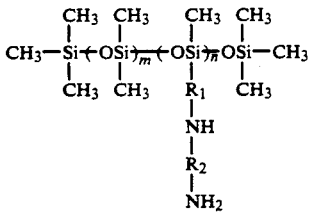

(1)

wherein m and n each represents an integer of preferably 1 to 100,000, more preferably 5 to 5,000, provided that (m+n) is an integer of 10 or more, preferably 20 to 100,000, and more preferably 50 to 10,000, and $R_1$ and $R_2$, which may be the same or different, each represents an alkylene having from 1 to 10 carbon atoms or arylene group having 6 to 10 carbon atoms.

Such an aminopolysiloxane are disclosed in, for example, U.S. Pat. No. 4,830,845, JP-A-2-91224, JP-A-2- and JP-A-2-91226.

Preferred examples of an alkylene group and an arylene group include a methylene group, an ethylene group, and a propylene group. Examples of aminopolysiloxanes represented by formula (1) include the following:

| Compound No. | $R_1$ | $R_2$ | m | n |
|---|---|---|---|---|
| 1 | propylene | methylene | 250 | 7 |
| 2 | ethylene | ethylene | 250 | 5 |
| 3 | propylene | propylene | 100 | 10 |
| 4 | propylene | ethylene | 650 | 10 |

A dialkyl sulfosuccinate which is used as component (B), is represented by formula (2)

$$\begin{array}{l} R_3OOC-CH-SO_3X \\ \quad\quad\quad\;\; | \\ R_4OOC-CH_2 \end{array} \qquad (2)$$

wherein $R_3$ and $R_4$, which may be the same or different, each represents a hydrogen atom or an alkyl group having 1 to 100 carbon atoms, preferably 6 to 10 carbon atoms, and X is H, K, Na, Li or $NH_4$. The dialkyl sulfosuccinate may be prepared according on the method disclosed in, for example, *C. R. Caryl. Ind. Eng. Chem.* Vol. 31, page 45 (1939).

Examples of a dialkyl sulfosuccinate include dimethyl sulfosuccinate, dioctyl sulfosuccinate, and dicetyl sulfosuccinate.

The dialkyl sulfosuccinate is used in an amount preferably of from 10 to 100 parts, more preferably 20 to 50 parts by weight per 100 parts by weight of the aminopolysiloxane to be used. When the amount of the dialkyl sulfosuccinate is less than 10 parts by weight, the effects of the present invention are not sufficient. On the other hand, when the amount is more than 100 parts by weight the formation of coated film tends to become difficult.

The aminopolysiloxane may be applied to a fiber strand after, or preferably prior to application of the dialkyl sulfosuccinate, but these compounds more preferably are applied to the fiber simultaneously as a mixture thereof from the industrial point of view and because the compounds can be applied to the fiber uniformly.

Components (A) and (B) may be used by dissolving or dispersing them in water preferably at a total solids concentration of 1 to 30 g/l in both cases of separate use thereof or of use thereof as a mixture thereof. The applying temperature is generally from about 20° to 50° C. When the aminopolysiloxane cannot be dispersed sufficiently in water, surfactants such as a nonionic surfactant, e.g., a polyoxyethylene alkyl ether and a polyoxyethylene nonyl phenyl ether can be used preferably in an amount of not more than 100% by weight based on the weight of aminopolysiloxane. Aminopolysiloxanes are usually commercially available in a form of an emulsion of the aminopolysiloxane. The emulsion usually contain surfactants (other than the dialkyl sulfosuccinate) such as those described above. Such an emulsion can be used directly in the present invention.

These compounds may be applied to the acrylic fiber at any stage after spinning of the acrylic polymer either by a dry or wet spinning method.

These compounds preferably are applied to acrylic fiber strands which are in a water-swollen state after the water washing step, but prior to the following drying-densifying step (by drying the water-swollen fiber the fiber is densified). The reason for this is that while a pseudo-coalescence in fiber strands (slight coalescence of filaments in the strand, which can be spread by, for example, an air jet) occurs during the drying-densifying step when water content of the strands is reduced to 100 to 20% (based on the weight of the dry fibers which comprise the strand) by weight, such a pseudo-coalescence can be preferably prevented by the presence of the compounds applied before the drying-densifying step.

In the present invention, the compounds are present on the surface of filaments, and it is considered that at least a part of them (with respect to the amount) are impregnated to the inside of the filaments when they are applied to the fibers in a water-swollen state.

The term "water-swollen fiber strand" as used herein is preferably a fiber strand which has been subjected to solvent removal by washing with water and, if desired, to stretching during or after washing, and has a water content preferably of about 50 to 300% (based on the wet of the dry fiber), more preferably 100 to 200% by weight (based on the weight of the dry fiber). Fiber strands usually having at least about 50% by weight of water content are supplied to the drying-densifying step.

Examples of the means to apply components (A) and (B) to fiber strands include a dipping process, spraying, roller transfer, lip process and the like, of which the dipping process is particularly preferred in view of uniform application of the compounds to the inside of the fiber strand. Components (A) and (B) are preferably applied to an acrylic fiber strand in an amount of from 0.05 to 2.0%, more preferably of from 0.2 to 1.0% by weight, in terms of the total solid contents of the compounds based on the weight of dry fibers. If the amount is less than 0.05% by weight would bear no significant coalescence-preventing effect, and if it exceeds 2.0% by weight the strength of carbon fibers after baking tends to reduce.

The term "carbon fiber strand" is used herein in a broad sense which includes graphite fiber strands. The acrylic fiber strands used herein are preferably a fiber strand consisting of about 50 to 350,000, more preferably about 300 to 35,000 filaments which comprise a homopolymer or a copolymer (hereinafter both are referred to as a polymer) preferably containing at least 90%, more preferably 93 to 99% by weight of acrylonitrile. The molecular weight of the polymer is generally about 50,000 to 200,000 (weight average; the same hereinafter).

Acrylic fiber can be produced by conventional methods disclosed in, for example, U.S. Pat. Nos. 4,659,845, 4,830,845 and 4,869,856.

A comonomer to be copolymerized with acrylonitrile in the present invention may be selected from usually used comonomers for the same purpose. Examples of the comonomers include alkyl acrylates (methyl acrylate, ethyl acrylate, butyl acrylate and the like), alkyl methacrylates, vinyl acetate, acrylamide, acrylic acid, itaconic acid, methacrylic acid, vinyl sulfonate, aryl sulfonate and salts thereof (e.g., K, Na, Li or $NH_4$ salts); and vinyl acetate, vinyl imidazole, vinyl pyridine and derivatives thereof (e.g., compounds substituted with an alkyl group). Two or more comonomers may be used in the acrylic fiber if desired.

Examples of solvents for use in the wet-spinning of the acrylonitrile homopolymer or copolymer include organic solvents such as dimethyl formamide (DMF), dimethyl sulfoxide (DMSO), dimethyl acetamide (DMA) and the like and inorganic solvents such as zinc chloride, rhodanate, nitric acid and the like. Especially, a zinc chloride-containing aqueous solution is preferable for use in the wet-spinning of acrylic fibers. The term "zinc chloride-containing aqueous solution" as used herein refers to an aqueous solution containing zinc chloride as a main component with its concentration being sufficient to dissolve the acrylonitrile polymer. A preferred concentration is from 50 to 60% by weight based on the weight of aqueous solution of $ZnCl_2$. Such a concentrated aqueous solution of zinc chloride supplemented with additional inorganic salts such as sodium chloride, magnesium chloride, ammonium chloride and the like may also be used. Preferably, the mixing ratio of zinc chloride in such a salt mixture is about 65% by weight or more based on the total weight of zinc chloride and the salt.

A spinning solution may be prepared by usually used means in the art such as dissolution of an acrylic polymer, solution polymerization and the like. When a zinc chloride-containing aqueous solution is used as a solvent, a polymer may be used in a concentration of from 1 to 25% by weight, preferably from 3 to 15% by weight, more preferably from 4 to 12% by weight based on the weight of the polymer solution. The same polymer concentration can be used when an organic solvent is used for preparation of spinning solution.

Wet spinning may be effected by conventional means, for example, by directly discharging an acrylic polymer solution into a coagulating bath having a low concentration spinning solvent or by firstly discharging the polymer solution in the air and then introducing the discharged product into a low concentration spinning solvent to remove the solvent. The solvent is then removed by washing the product with water preferably until the amount of the remaining solvent (when $ZnCl_2$ solution is used as a solvent, the amount of $ZnCl_2$) becomes 0 to 0.3% by weight.

For example, when a zinc chloride-containing aqueous solution is used as a solvent, spinning may be effected by using a spinning nozzle of about 1,000 to 12,000 holes having a diameter of from 0.05 to 0.07 mm (such as one disclosed in JP-A-58-13714) and a coagulation bath with a zinc chloride concentration of from about 10 to 40% by weight based on the weight of $ZnCl_2$ aqueous solution.

Generally the discharge rate of the polymer solution is from 5 to 50 m/min, preferably from 10 to 30 m/min, the temperature of a coagulation bath is from about −20° to +25° C., preferably from about 0° to 15° C., more preferably from about 5° to 10° C., the time for coagulation is from 3 to 60 seconds and the draft ratio (pick up speed of the fiber from the coagulation bath/linear speed of discharging) is from about 0.2 to 10. Thereafter, the solvent is washed out with water, and generally, during which stretching at a stretching ratio of about 2 to 4 times the length before the stretching is carried out. Washing may be conducted at a temperature of from 15° to 95° C. for from about 5 to 10 minutes.

Stretching is preferably carried out both before and after a drying-densifying step, with a total stretching ratio preferably of from about 5 to 20 times, more preferably from 8 to 18 times the fiber length before the stretching.

Stretching before the drying-densifying step may be carried out using water as a stretching medium and at a temperature of from about 15° to 95° C. to attain a stretching ratio of preferably from about 2 to 6, more preferably from about 2 to 4 times.

Fibers just after spinning generally contain 400% by weight or more of water, but are de-swelled as the orientation of the molecules thereof progresses and their water content usually reaches 100 to 200% by weight based on the dry fiber after washing. Preferably, the aminopolysiloxane and a dialkyl sulfosuccinate are applied to such water-swollen fiber strands, although these compounds may also be added to fibers having a water content within a wider range such as of from 50 to 300% by weight.

The water-swollen fiber strands thus treated with these two types compounds are then subjected to drying-densifying, re-stretching, and controlling of water content (if desired).

Drying-densifying generally effected by a heating roller contact means, a suction drum system or the like, but preferably by a hot air circulation system using a suction drum dryer. The temperature of the drying is usually from about 70° to 150° C., and the time is usually from about 3 to 600 seconds, preferably from about 60 to 120 seconds. During the drying step, the acrylic fibers preferably are maintained under a stretched condition with a constant length or with a shrinkage percentage of 15% or less.

It is considered that after the drying-densifying step the aminopolysiloxane having a high affinity to the fiber is adhered to the fibers and the resulting fiber surface is further coated with the hydrophilic dialkyl sulfosuccinate. As a result, generation of scum by the falling off of the aminopolysiloxane does not occur and the bundlability of filaments in a strand is improved with no fluffing or winding by static electricity.

In the re-stretching step after the drying-densifying step, fibers are stretched 2 to 10 times the length of the fiber before the re-stretching, preferably 4 to 8 times, in a saturated steam at a pressure of from preferably about 0.2 to 3.0 $kg/cm^2(G)$, and more preferably about 0.4 to 1.2 $kg/cm^2(G)$. When the aminopolysiloxane is used alone, the water repellency of the acrylic fibers after the drying-densifying step becomes high, stretchability is reduced and fluffing becomes frequent. On the contrary, according to the present invention, fibers having excellent stretchability with less fluffing can be obtained.

These steps for production of the acrylic fiber may be performed at ambient pressure.

The thus obtained acrylic fiber usually has a fineness of from 0.3 to 1.5 denier/filament.

The water content of the acrylic fiber strand which has passed through the aforementioned steps is adjusted so that the water content of the strand is 30 to 50% by weight based on the dry fiber, and then the fiber strand is generally packed in a can in order to be used for the production of proxidized fiber. If the water content is less than 30%, the collectivity of filaments in a strand is not sufficient, while when it exceeds 50% it is difficult to keep the water to be impregnated in the strand.

When the water content of the strand after re-stretching is lower than 30% by weight, it can be adjusted to an appropriate level by adding water by means of spraying, a dipping process, roller transfer, a lip process and the like. In the case of use of the aminopolysiloxane alone, it is substantially impossible to impregnate the acrylic fiber strand with water because the fibers become water repellent. When the water content of the strand is higher than 50% by weight, it can be adjusted to an appropriate level by controlling the squeezing pressure of a nip roller.

Since the acrylic fiber strand obtained in this manner forms an aminopolysiloxane film on the filament during preoxidation, and the thus formed coated film can improve bundlability of the filaments in a strand but is not sticky, the strand does not cause deposition of scum on rollers and guides. As a consequence, smooth operation of the process steps and, therefore, stable continuous operation can be attained by the use of the acrylic precursor of the present invention.

The preoxidation of the acrylic fibers of this invention having the components (A) and (B) applied thereto can be carried out using any conventional preoxidation conditions for acrylic fibers.

Preferably, the preoxidation treatment is using conventional preoxidation conditions disclosed in, for example, U.S. Pat. No. 4,397,831. Generally the pre-oxidation is carried out in air at about 200° to 300° C., especially about 240° to 280° C., for about 0.1 to 1 hour with a tension on the fiber of about 10 to 100 mg/d until the specific gravity of the fibers becomes about 1.30 to 1.45.

Carbonization of the thus obtained preoxidized fibers is carried out using conventional carbonization conditions as disclosed in, for example, U.S. Pat. No. 4,522,801. Generally it is carried out in an inert gas atmosphere such as nitrogen, argon or helium at about 600° to 1,500° C. for from about 2 to 3 minutes with a tension on the fibers of about 10 to 300 mg/d. The aminopolysiloxane and the succinate are heat-decomposed during the carbonization and evaporated from the fiber strand. As a result, carbon fibers having a tensile strength of more than 350 kg/mm$^2$ can be obtained in a stable manner. Graphitization of the thus obtained carbon fiber may be carried out using conventional graphitization conditions as disclosed in, for example, U.S. Pat. No. 4,321,446. Generally the carbon fiber is subjected to a higher heating (e.g., at 2,000° to 2,400° C. for from about 60 to 180 seconds) in an inert atmosphere (such as those described above) to obtain a graphite fiber strand having excellent mechanical properties.

Examples of the present invention are given below by way of illustration and not by way of limitation.

EXAMPLE 1

Using a 60% by weight zinc chloride-containing aqueous solution as a solvent, a spinning solution containing 8% by weight of a polymer having a molecular weight of 78,000 and consisting of 97% by weight of acrylonitrile and 3% by weight of methyl acrylate was prepared. The thus prepared spinning solution was discharged through a nozzle having 12,000 spinnerets into a 25% by weight zinc chloride aqueous solution which had been controlled to have a temperature of 10° C. The draft ratio was 0.35. The coagulated fibers thus formed were washed with warm water at a temperature which was gradually elevated from 15° to 95° C., simultaneously performing multiple stage stretching to attain a total stretch of 3.2 times as shown below.

| Temperature (°C.) | Time (sec) | Stretching Ratio |
|---|---|---|
| 15 | 30 | 1.4 |
| 25 | 180 | 1.0 |
| 40 | 60 | 1.1 |
| 60 | 180 | 1.0 |
| 75 | 10 | 1.2 |

-continued

| Temperature (°C.) | Time (sec) | Stretching Ratio |
|---|---|---|
| 95 | 10 | 1.8 |

The amount of water used for continuous washing was 80 l per Kg of the strand. In this way, a water-swollen acrylic fiber strand having a water content of 170% by weight was obtained. The thus obtained water-swollen fiber strands were treated with various treating agents (dispersed in water) in such a manner that the total applied amount of the aminopolysiloxane and the dialkyl sulfosuccinate to the fiber adjusted to 0.5% by weight. These agents were prepared by mixing an aminopolysiloxane represented by the following chemical formula (N content, 0.7% by weight; viscosity, 3,500 cs at 25° C.) with sodium dioctyl sulfosuccinate in various mixing ratios as shown in Table 1. The total amount of the compounds was 25 g/l. The strand was impregnated in the dispersion at 30° C. for 4 seconds.

The dispersion was prepared by dispersing an emulsion of the aminopolysiloxane (comprising 20% by weight of the aminopolysiloxane, 10% by weight of polyoxyethylene alkyl ether and 70% by weight of water) into an aqueous solution containing the dialkylsulfosuccinate.

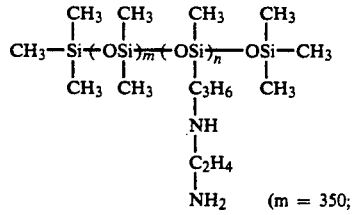

The thus treated fiber strands were subjected to drying-densifying for 90 seconds to reduce the water content in the fiber to a level of 1% by weight or below, using a suction drum dryer heated at a temperature which was gradually elevating from 70° to 150° C. as shown below.

| Drum | Temperature (°C.) |
|---|---|
| 1st | 70 |
| 2nd | 90 |
| 3rd | 100 |
| 4th | 120 |
| 5th | 140 |
| 6th | 150 |

Thereafter, the thus dried fiber strand was passed through a hot water bath of 80° C. spending 3 seconds, restretched 4.5 times in saturated steam at a pressure of 0.7 kg/cm$^2$(G) to obtain a acrylic fiber strand of 0.9 denier 12,000 filaments and then packed them in a can. Characteristics of acrylic fiber strand thus prepared are shown in Table 1.

These acrylic fiber strand were subjected to a preoxidizing treatment continuously for 40 minutes according to a usually used means using a hot air circulating furnace having a temperature gradient ranging from 240° to 270° C. as shown below.

| Temperature (°C.) | Time (minute) |
|---|---|
| 240-250 | 5 |

-continued

| Temperature (°C.) | Time (minute) |
|---|---|
| 250–260 | 20 |
| 260–270 | 15 |

Thereafter, the resulting precursors were heat-treated in a carbonization furnace having a temperature gradient ranging from 300° to 1,300° C. under a tension as shown below in a stream of nitrogen to obtain carbon fibers.

| Temperature (°C.) | Time | Tension (mg/d) |
|---|---|---|
| 300–400 | 30 seconds | 80 |
| 400–500 | 60 seconds | 80 |
| 500–600 | 30 seconds | 80 |
| 700–1000 | 1 minute | 200 |
| 1000–1200 | 1 minute | 200 |
| 1200–1300 | 1 minute | 200 |

Characteristics of fibers during and after these treatments are shown in Table 2.

TABLE 1

| Exp. No. | Weight Ratio of Compounds (A)/(B) | Adhered Compounds (weight %) | Scum During Drying | Water Content (weight %) |
|---|---|---|---|---|
| 1 | (A) only | 0.50 | x | 5 |
| 2 | 100/10 | 0.48 | ○ | 30 |
| 3 | 100/40 | 0.51 | ○ | 38 |
| 4 | 100/100 | 0.49 | ○ | 37 |
| 5 | 100/230 | 0.50 | ○ | 40 |
| 6 | (B) only | 0.48 | ○ | 45 |

Note 1:
Formation of scum was judged based on the following criteria.
x: adhesion of scum to guide and roller, with fluffing and winding of fibers
Δ: adhesion of scum to some extent, but with no difficulty in performing continuous operation
○: no adhesion of scum
Note 2:
Experiment Nos. 2 to 5 are examples of the present invention, and Nos. 1 and 6 are comparative examples.

TABLE 2

| Exp. No. | Scum during Preoxidation Treatment | Bundlability of Pre-oxidized Fiber | Carbon Fibers Strength (kgf/mm²) | Carbon Fibers Fluff (numbers/m) |
|---|---|---|---|---|
| 1 | x | Δ | 380 | 810 |
| 2 | ○ | ◎ | 481 | 56 |
| 3 | ○ | ◎ | 453 | 35 |
| 4 | ○ | ◎ | 446 | 39 |
| 5 | Δ | ○ | 351 | 511 |
| 6 | Δ | x | 282 | 1340 |

Note 1:
Bundlability of preoxidized fibers was judged based on the following criteria.
x: considerably poor bundlability, with spreading of fiber strand by hot air
Δ: poor bundlability, with formation of sticky coat film on fiber strand and with frequent fluffing
○: good bundlability, with no spreading of fiber strand by hot air
◎: markedly good bundlability, with formation of non-sticky coat film on fiber strand
Note 2:
Experiment Nos. 2 to 5 are examples of the present invention, and Nos. 1 and 6 are comparative examples.

As is evident from the results shown in Tables 1 and 2, operation stability of the production process of acrylic fiber and carbon fibers can be improved greatly and the resulting carbon fibers are endowed with markedly high mechanical strength, when an aminopolysiloxane compound and a dialkyl sulfosuccinate are used, especially when dialkylsulfosuccinate is used in an amount of from 10 to 100 parts by weight based on 100 parts by weight of the aminopolysiloxane.

As stated hereinabove, according to the present invention, operation stability of the production process of acrylic fiber strand can be improved, because generation of aminopolysiloxane scum is prevented and bundlability of filaments in a strand is improved by the use of the aminopolysiloxane and dialkyl sulfosuccinate. By the use of the acrylic fiber strands of the invention, bundlability of the filaments in a strand during the preoxidizing step is improved due to the formation of aminopolysiloxane coat film, and fluffing, filament breakage and the like troubles are prevented during carbonization step, thus resulting in the improvement of operation stability and formation of high quality carbon fibers.

While the invention has been described in detail and with reference to specific embodiments thereof, it will be apparent to one skilled in the art that various changes and modifications can be made therein without departing from the spirit and scope thereof.

What is claimed is:

1. An acrylic fiber strand for use in carbon fiber production which comprises acrylic polymer filaments coated with an aminopolysiloxane and at least 10 parts by weight of a dialkyl sulfosuccinate per 100 parts by weight of the aminopolysiloxane, wherein the total amount of the aminopolysiloxane and the dialkyl sulfosuccinate is from 0.05 to 2.0% by weight based on the weight of dry fiber.

2. The acrylic fiber strand as claimed in claim 1, wherein the dialkyl sulfosuccinate is contained in an amount of from 10 to 100 parts by weight per 100 parts by weight of the aminopolysiloxane.

3. The acrylic fiber strand as claimed in claim 1, wherein the aminopolysiloxane is a compound which forms a film at a preoxidation temperature.

4. The acrylic fiber strand as claimed in claim 3, wherein the preoxidation temperature is 200° C. or higher.

5. The acrylic fiber strand as claimed in claim 1, wherein the aminopolysiloxane is a compound represented by formula (1):

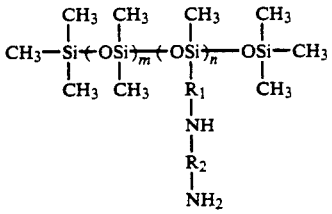

(1)

wherein m and n each represents an integer of from 1 to 100,000, provided that m+n is an integer of 10 or more, and $R_1$ and $R_2$ each represents an alkylene or arylene group having 1 to 10 carbon atoms.

6. The acrylic fiber strand as claimed in claim 1, wherein the dialkyl sulfosuccinate is a compound represented by formula (2):

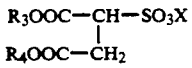

(2)

wherein $R_3$ and $R_4$ each represents a hydrogen atom or an alkyl group having from 1 to 100 carbon atoms and X represents H, K, Na, Li or $NH_4$.

7. The acrylic fiber strand as claimed in claim 1, wherein the acrylic fiber strand consists of from 50 to 350,000 filaments.

8. The acrylic fiber strand as claimed in claim 1, wherein the acrylic fiber comprises a polymer or a copolymer containing at least 90% by weight of acrylonitrile.

* * * * *